United States Patent [19]

Krug et al.

[11] 4,349,465

[45] Sep. 14, 1982

[54] PROCESS FOR THE TREATMENT OF COMBUSTIBLE, SOLID RADIOACTIVE WASTES

[75] Inventors: Günter Krug, Bruchsal; Helfried Lahr, Karlsdorf; Peter Schween, Karlsruhe; Herbert Wieczorek, Weingarten, all of Fed. Rep. of Germany

[73] Assignee: KEWA Kernbrennstoff-Wiederaufarbeitungs-Gesellschaft mbH, Hanover, Fed. Rep. of Germany

[21] Appl. No.: 141,700

[22] Filed: Apr. 18, 1980

[30] Foreign Application Priority Data

Apr. 21, 1979 [DE] Fed. Rep. of Germany ..... 2916203

[51] Int. Cl.[3] ..... G21F 9/34

[52] U.S. Cl. ..... 252/626; 241/23; 241/DIG. 37; 241/DIG. 38

[58] Field of Search ..... 252/301.1 W, 626; 241/DIG. 37, DIG. 38, 23; 260/687 R

[56] References Cited

U.S. PATENT DOCUMENTS

| | | | |
|---|---|---|---|
| 3,776,856 | 12/1973 | Scheffler et al. | 252/301.1 W |
| 3,884,162 | 5/1975 | Schuster | 241/DIG. 37 |
| 3,957,676 | 5/1976 | Cooley et al. | 252/301.1 W |
| 4,073,443 | 2/1978 | Danioni | 241/DIG. 37 |

OTHER PUBLICATIONS

Lerch, "Treatment of Alpha-Bearing Combustible Wastes Using Acid Digestion", HEDL-SA-1392 (1978).

*Primary Examiner*—Deborah L. Kyle
*Attorney, Agent, or Firm*—Spencer & Kaye

[57] ABSTRACT

In a process for the wet combustion of solid, combustible, radioactive wastes by reaction with concentrated sulfuric and nitric acids or $NO_x$ at elevated temperatures, the improvement wherein the waste, prior to the reaction, is subjected to a preliminary comminution to a particle size less than or equal to 20 mm, and then to a primary comminution, at a temperature less than about 123° K, to a particle size less than or equal to 1 mm.

8 Claims, No Drawings

PROCESS FOR THE TREATMENT OF COMBUSTIBLE, SOLID RADIOACTIVE WASTES

BACKGROUND OF THE INVENTION

The present invention relates to a process for the treatment of combustible, solid radioactive wastes, especially wastes containing radionuclides emitting alpha radiation, in which the wastes are oxidized (that is, combusted in the wet state), at elevated temperatures, by a combination of concentrated (more than 16 moles/liter) sulfuric acid and concentrated nitric acid or $NO_x$. Valuable radioactive materials may be recovered from the resultant solid residue.

The treatment of combustible, solid radioactive wastes is based on the concept of converting such wastes into a noncombustible condition in a minimally hazardous way. A simultaneous, extensive reduction in volume is desirable to make the final, permanent disposal and/or storage of the thus-concentrated radioactive substances simpler and more economical. A normal combustion of, for example, cellulose-containing material, or rubber or synthetic resins in a furnace entails disadvantages in most cases in that part of the radioactive substances is entrained as suspended particles with the smoke, thus requiring special gas cleaning devices to free the evolving gases from the radioactive particles. Quite generally, a certain risk is incurred by the presence of suspended radioactive particles, inherent in practically any open combustion process. Additionally, with such a combustion method, the plutonium contained in the waste materials is converted to sparsely soluble plutonium oxides and plutonium mixed oxides. Attempts have been made to avoid these disadvantages of open combustion by conducting a chemical destruction of the aforementioned wastes.

Using processes known as wet combustion, combustible wastes have been treated with strongly oxidizing acids, such as, for example, nitric acid, or the oxidative properties of concentrated sulfuric acid at elevated temperatures, for example in the proximity of the $H_2SO_4$ boiling point, have been exploited. In this connection, oxidation catalysts have been used, such as selenium, as disclosed in German Pat. No. 1,295,724. The use of selenium is disadvantageous, however, since the element is toxic.

In another prior art process, disclosed in U.S. Pat. No. 3,957,676, the solid wastes are allowed to react with concentrated sulfuric acid at a temperature in the range of from 503° K. to 573° K. (230°–300° C.), and simultaneously and/or thereafter, the waste materials subjected to the reaction are brought into contact with concentrated nitric acid or nitrogen oxides. These reactions cause oxidation of the wastes within the reaction liquid. The solid residue thus produced is separated from the liquid, and valuable radioactive materials are recovered from the residue. Thereafter, the residue, free of the valuable matter, is disposed of, and the $H_2SO_4$ and the $HNO_3$ are recovered and recycled into the process.

It is stated in U.S. Pat. No. 3,957,676 that in laboratory tests, volume reductions of up to a factor of 160 have been attained using this wet combustion process. A very small amount of acid is said to be consumed in the process, if the acid is processed after use, and reused. The oxidizing step in this process is conducted at or in the close proximity of the reflux temperature of sulfuric acid and should be within the temperature range of 503° to 573° K. For lower temperatures, the reaction rate is said to be lower, and although this offers a means to control the reaction, higher temperatures of about 543° K. (270° C.) are generally preferable for a complete reaction. The process can be conducted at or somewhat above atmospheric pressure, which is said to be an advantage in retaining the radioactive contaminants. Although a relatively high temperature (543° K.) is utilized for the oxidizing step, the throughput of material to be combusted in this process per unit time is relatively small. Thus, approximately 8½ hours are necessary for 100 g. of mixed waste material from the point of introduction of the waste material into the heated, concentrated sulfuric acid to complete oxidation of the waste material.

It is a further disadvantage of this type of wet combustion process that large amounts of energy are required in the reaction of the waste with the concentrated sulfuric acid and in the oxidation with nitric acid. The conventional processes are further disadvantageous in that the reactions exert a relatively high stress on the materials of the reaction vessels, and there is an additional danger of lump formation and/or a partial conglomeration of waste pieces due to melting, factors which at least impede the normal course of the process.

SUMMARY OF THE INVENTION

It is an object of the present invention to provide a process for the treatment of combustible, solid radioactive wastes, especially wastes containing radionuclides emitting alpha radiation, which can be conducted continuously.

It is also an object of the present invention to provide a process for the treatment of combustible, solid radioactive wastes which permits a complete oxidation of the waste materials.

It is another object of the present invention to provide a process for the treatment of combustible, solid radioactive wastes which permits the attainment of a markedly higher throughput of waste materials than prior art processes, in a facility which is more compact than those of prior art processes.

It is another object of the present invention to provide a process by which at least 20 kg per hour of solid, combustible radioactive waste may be treated.

It is a further object of the present invention to provide a method for the treatment of combustible, solid radioactive wastes which is gentle to the materials of the apparatus used.

Additional objects and advantages of the present invention will be set forth in part in the description which follows and in part will be obvious from the description or can be learned from practice of the invention. The objects and advantages are achieved by means of the processes, instrumentalities, and combinations particularly pointed out in the appended claims.

To achieve these objects, and in view of its purpose, the present invention provides in a process for the treatment of solid, combustible radioactive wastes, wherein the wastes are contacted with sulfuric acid of a concentration of greater than 16 moles per liter and reacted with this sulfuric acid at an elevated temperature, and concentrated nitric acid or nitrogen oxides are added to the sulfuric acid, whereby oxidation of the wastes occurs below the surface of the sulfuric acid and gaseous by-products and a solid residue are formed, the improvement comprising subjecting the solid wastes, prior to their reaction with sulfuric acid, to mechanical processing which comprises (a) a preliminary comminution to waste pieces having a size less than or equal to 20 mm, and (b) a primary comminution by finely grinding the waste pieces produced in step (a) to a size of less than or equal to 1 mm at a temperature of less than about 123° K.

Preferably, the waste pieces from step (a) are made brittle in liquid nitrogen and then ground in a cold-grinding mill.

It is also preferred to form a suspension from the ground material from step (b) and 90% strength sulfuric acid at less than 313° K. By the fine comminution of the waste in step (b) and by forming a suspension with cold 90% sulfuric acid, the waste becomes pumpable and can be readily introduced into a reaction vessel with a rapid liquid circulation. If such a waste-$H_2SO_4$ suspension is heated to the reaction temperature while being conveyed to the reaction vessel, the conversion rate is considerably higher than in the case of the prior art processes.

In another preferred embodiment of the present invention, the reaction of the wastes with sulfuric acid is conducted at a vacuum in the range from 100 m bar to 500 m bar. Preferably, the reaction of the wastes with sulfuric acid is conducted at a temperature of at most 493° K.

It is to be understood that both the foregoing general description and the following detailed description are exemplary but are not restrictive of the invention.

DETAILED DESCRIPTION OF THE INVENTION

In the process of the present invention, solid, combustible, nuclear waste, especially that containing radionuclides emitting alpha radiation, is subjected to a two-step mechanical processing treatment, prior to a wet combustion treatment. Exemplary waste material is described in U.S. Pat. No. 3,957,676, incorporated in its entirety herein by reference, and includes both uranium and plutonium bearing wastes.

It is contemplated that in the majority of cases, the waste material to be processed according to the present invention will be a mixed waste material comprising by weight, about 40% to 50% polyvinyl chloride, about 15% to 25% neoprene, about 10% to 20% cellulose, about 5% to 10% polyethylene, and about 5% to 10% polypropylene. Under actual operating conditions, it is expected that the waste material will also comprise noncombustibles such as metallic parts, glass, ceramic material, and the like. Since such components interfere with the controlled operation of the process, and can result in a reduction of the useful life of the blades used in the preliminary comminution stage of the mechanical treatment, it is absolutely necessary to inspect the waste as delivered, and possibly to pre-sort it. The noncombustible waste can then be diverted to waste-compaction and the combustible waste to the mechanical treatment of the present invention.

The combustible waste which is directed to the two-step mechanical treatment is subjected in the first step to a preliminary comminution. In the preliminary comminution, the waste is reduced to pieces of a size less than or equal to about 20 mm. The preferred size range is from 5 to 20 mm. A slow running cutting mill or a shredder can be used as devices for carrying out the preliminary comminution. A nitrogen-containing waste gas is produced by the preliminary comminution and is purified by means of an exhaust gas line to such an extent that it corresponds in quality to the exhaust gas of the wet combustion process.

The waste pieces are then subjected to the second step of the two-step mechanical treatment. This second step is a primary comminution of the waste pieces at a temperature of less than about 123° K. (−150° C.). The preferred temperature range is from 77° K. (−196° C.) up to 123° K. In the primary comminution, the waste pieces are rendered brittle, for example, with the use of liquid nitrogen, and then ground in a cryogenic-grinding mill. In the primary comminution, a particle size of about 1 mm or less is achieved preferably a particle size in the range from 0.1 up to 1 mm. A screening means is generally a part of the grinding means. The exhaust gas from this cryogenic grinding is used to dilute the exhaust gas from the wet combustion.

In a preferred embodiment of the present invention, a suspension then is formed from the extremely finely ground waste material produced by the primary comminution and concentrated sulfuric acid by introducing the waste material in metered amounts into concentrated sulfuric acid (greater than 16 M) by means such as a cell-wheel gate valve. By mixing with the waste, under agitation, fresh sulfuric acid of about 90% concentration or sulfuric acid recycled from the present process (and concentrated to about 90%) a homogeneous mixture is produced, in the form of a suspension, which is suitable for pumping and which can be readily introduced into a wet combustion reaction vessel having a rapid liquid circulation. In order to form this pumpable suspension, the mixing with the sulfuric acid takes place at a temperature maintained at less than about 313° K. (40° C.), preferably at a temperature in the range from room temperature to 313° K.

Advantageously, the mixture is now pumped and heated to close to the wet combustion reaction temperature directly into a transport line, so that the mixture is at the reaction temperature when it is delivered to the reaction vessel, where it is mixed with rapidly circulating reaction liquid. This preliminary heating insures a higher conversion rate than prior art processes in which the waste is added directly to hot $H_2SO_4$. The $HNO_3$ required for the oxidation is added to the circulating liquid. The $HNO_3$ oxidizes carbonaceous material formed by the reaction of the wastes with the sulfuric oxide and is itself reduced principally to NO.

In a preferred embodiment of the present invention, the decomposition of waste in the reactor takes place at a temperature from 453° K. (180° C.) to no more than about 493° K. (220° C.), and/or at a pressure of about 100 to 500 m bar. In a further preferred embodiment, the decomposition takes place at 493° K. and a pressure of 300 m bar. The formation of a pumpable suspension as set forth above and the use of relatively low reaction and oxidation temperatures (of no more than about 493° K.) ensure that disturbances during the course of the process caused by waste particles sticking together or by the conglomeration of molten waste particles can be avoided.

A thermal syphon reactor well known as a thermal syphon evaporator of the ordinary state of the art, is preferably used for the reaction.

For the radioactive criticality safe layout a modified jacketed annular gap reactor (in vertical position), with outside liquid circulation (thermal syphon) is used having a gap or layer thickness of about 5 cm, is preferably used for the reaction. The amount of heat required to maintain the reaction temperature is supplied by circulating through the jacket a thermal oil or concentrated $H_2SO_4$. The reaction liquid, the gases generated, and steam leave the reactor at the top, and the vapors and gases are separated. The circulating (returning) reaction liquid then mixes first with freshly supplied waste suspension, and then with heated (353° K.–393° K.) concentrated (65–98 wt.%) niric acid, required for the oxidation. The nitric acid is introduced into the circulating liquid, which reenters the reaction vessel at the bottom. The nitric acid may be introduced into the circulating reaction liquid simultaneous with the start of the reaction or at a later time.

In the reaction vessel, the combustible organic matter of the waste reacts with the sulfuric acid in reactions which may be greatly simplified by the following representations:

$$C_mH_n+(n)/(2)H_2SO_4 \rightarrow nH_2O+(n)/(2)SO_2+mC \quad (1)$$

$$C+2H_2SO_4 \rightarrow 2H_2O+2SO_2+CO_2 \quad (2)$$

If nitric acid is present, reaction (2) tends to be suppressed in favor of the following reaction:

$$3C+4HNO_3 \rightarrow 4NO+2H_2O+3CO_2 \quad (3)$$

Above the liquid in the reactor, a weak oxygen stream preferably is introduced. This stream oxidizes NO to $NO_2$, which, in turn, oxidizes $SO_2$ to $SO_3$.

It should be pointed out that as an alternative to adding $HNO_3$, oxides of nitrogen, $NO_x$, and especially $NO_2$ may be added. $HNO_3$, however, is preferred.

As compared with dry-combustion process, an extensive breakdown of plutonium oxides is attained in the present wet-combustion process.

The decomposition residues preferably are withdrawn as an approximately 5% (range: 2–20 wt.%) suspension in $H_2SO_4$, cooled to less than 313° K. (40° C.), and separated by means of a pressure filter at a maximum pressure of 10 bar into a filter cake and $H_2SO_4$ filtrate which may be recycled. The filter cake is then dried to remove sulfuric acid at about 743° K. (470° C.) at 200 m bar, and leached out with dilute The solution produced by this leaching contains $Pu(SO_4)_2$, and is separated from the residue. The residue has become maximally free of plutonium and is passed on for waste compaction. The plutonium-containing solution can be rendered extensively free of sulfate by precipitation of sulfate with calcium and separation of the calcium sulfate precipitate, so that an extraction of plutonium with tributyl phosphate/kerosene is made possible. The purified $CaSO_4$ also passes over to waste compaction. From the plutonium-containing solution, the uranium, likewise contained therein, and the plutonium are separated by extraction with a tributyl phosphate/kerosene mixture, and the re-extracted U/Pu solution is introduced, at a suitable point, into the extraction cycle of a reprocessing plant. After extraction of uranium and plutonium, the remaining aqueous waste solution is passed on for compaction.

The exhaust gases from the reactor are, after cooling to about 423° K. (150° C.), freed of any entrained droplets by means of a hydrocyclone and by a wet electrostatic filter. During this step, oxygen is added as an oxidizing agent. Thereafter the exhaust gas is conducted countercurrently to the condensate and thus cooled to condensation temperature. Condensation takes place at about 341° K. (68° C.). The noncondensable gases are removed by suction with the use of a suitable vacuum-generating device, for example a water ring pump or a water jet pump, and transferred into a first absorption column. In the lower section of this absorption column, the major amount of the remaining nitrogen-containing gases is scrubbed out. Above this first absorption column, the exhaust gas is cooled to less than 283° K. (10° C.), and in a second absorption column, located thereabove, the exhaust gas is completely cleansed of nitrogen-containing gases by countercurrently conducted, dilute hydrogen peroxide solution having a temperature of less than 283° K. (10° C.).

The absorber sump liquid and the condensate are degasified by heating to the boiling temperature and then introduced into an acid rectification stage, at a pressure of 100 to 300 m bar. In the acid rectification stage, the sulfuric acid is concentrated up to about 90% and then recycled into the process, and the vapors pass into the $HNO_3$ rectification. In the $HNO_3$ rectification, an approximately 68% strength $HNO_3$ is obtained which is then recycled into the process.

The head product of the $HNO_3$ rectification is introduced in part as scrubbing liquor into the second exhaust gas absorption column and the remainder is discharged. Due to the use of the $H_2O_2$ solution in the second absorption column, the nitrogen-containing gases are completely absorbed, as contrasted to the use of $H_2O$ and air in the prior art processes wherein there has always been a considerable loss of $NO_x$.

The following example is given by way of illustration to further explain the principles of the invention. This example is merely illustrative and is not to be understood as limiting the scope and underlying principles of the invention in any way. All percentages referred to herein are by weight unless otherwise indicated.

EXAMPLE

About 10 kg of a non-radioactive simulated waste mixture was subjected to preliminary comminution. This preliminary comminuted waste mixture had the following composition, by weight, and particle size:

| | | |
|---|---|---|
| 45% | polyvinyl chloride | (particle size 5mm) |
| 20% | neoprene | (particle size 10–15mm) |
| 15% | cellulose | (particle size 10–20mm) |
| 7.5% | granulated polyethylene | (particle size 5mm), and |
| 7.5% | granulated polypropylene | (particle size 5mm) |

The preliminary ground waste material was rendered brittle with liquid nitrogen and subjected to a primary comminution where it was ground in a cold-grinding mill at an average temperature of 113° K. (−160° C.). After the primary comminution, 96% of the waste exhibited a particle size smaller than 2 mm. The waste material was then sifted to less than 1 mm, at which size, about 80% passed through the sifter.

A suspension was then prepared in a cooled 2-liter, agitated vessel, by adding with agitation, 360 g of the finely comminuted and sifted waste, in incremental portions, to 1.440 kg of 90% $H_2SO_4$. The temperature rose during mixing from 295° K. (22° C.) to 311° K. (38° C.).

The decomposition of the waste in this suspension was carried out in a 2 liter, electrically heated, forced circulation evaporator (thermal syphon evaporator). Within one hour, 800 g of waste suspension were decomposed at 490° K. (217° C.) at a pressure of 300 m bar. 730 grams of 98% $HNO_3$ were required for the decomposition. The vapors were condensed at about 343° K. (70° C.) in a condenser, and the non-condensible exhaust gases were removed by suction with the use of a water jet pump from the condenser.

The removed non-condensible exhaust gases were fed into a scrubbing column, containing a Raschig ring packing having a height of 1 m. and a diameter of 60 mm. The scrubbing column was rinsed with dilute $HNO_3$. Within one hour, 250 ml. of 10% $H_2O_2$ solution was added to the rinsing liquid. No NO and no $NO_2$ could be detected any longer in the exhaust gas, withdrawn from the head of the scrubbing column.

It will be understood that the above description of the present invention is susceptible to various modifications, changes and adaptations, and the same are intended to be comprehended within the meaning and range of equivalents of the appended claims.

We claim:

1. In a process for the treatment of solid, combustible radioactive wastes comprising plastic and/or rubber, wherein the wastes are contacted with sulfuric acid of a concentration greater than 16 moles per liter and are reacted with this sulfuric acid at an elevated temperature, and concentrated nitric acid or nitrogen oxides are added to the sulfuric acid, whereby oxidation of the wastes occurs below the surface of the sulfuric acid and gaseous by-products and a solid residue are formed, the improvement comprising:

(1) subjecting the solid wastes, prior to their reaction with sulfuric acid, to mechanical processing which comprises (a) a preliminary comminution to waste pieces having a size less than or equal to 20 mm, and (b) a primary comminution by finely grinding the waste pieces produced in step (a) to a size of less than ot equal to 1 mm at a temperature of less than about 123° K.;

(2) forming a suspension of the finely ground waste of step (1) with the sulfuric acid at a temperature of less 313° K.; and (3) reacting the finely ground waste with the sulfuric acid in said suspension.

2. Process according to claim 1 wherein the primary comminution of step (b) comprises rendering the waste pieces brittle in liquid nitrogen and then grinding the waste pieces in a cold-grinding mill.

3. Process according to claim 1 or 2 wherein the suspension of the finely ground waste is formed with about 90% sulfuric acid.

4. Process according to claim 1 or 2 wherein the reacting of the finely ground waste with the sulfuric acid is carried out at a pressure of about 100 to 500 m bar.

5. Process according to claim 4 wherein the reacting of the finely ground waste with the sulfuric acid is carried out at a temperature less than or equal to about 493° K.

6. Process according to claim 1 wherein the reacting of the finely ground waste with the sulfuric acid is carried out at a temperature less than or equal to about 493° K.

7. Process according to claim 1 wherein said residue is separated from the remainder of the reaction mixture, is treated in order to remove valuable radioactive material, and is compacted, and wherein the remainder of the reaction mixture and the gaseous by-products are recovered in order to obtain sulfuric and nitric acids for recycling into the process.

8. Process according to claim 1 wherein said radioactive wastes contain radionuclides emitting alpha radiation.

* * * * *